United States Patent [19]

Epner

[11] 4,223,547

[45] Sep. 23, 1980

[54] METHOD OF HOLE FORMING

[75] Inventor: Elliot J. Epner, Huron, Ohio

[73] Assignee: General Motors Corporation, Detroit, Mich.

[21] Appl. No.: 968,102

[22] Filed: Dec. 11, 1978

[51] Int. Cl.[3] ..... B21C 23/18; B21D 28/10

[52] U.S. Cl. ..... 72/254; 72/267; 72/334; 72/354; 83/51; 83/103

[58] Field of Search ..... 72/254, 267, 334, 352, 72/360, 354, 264, 266, 268; 29/557; 83/51, 103

[56] References Cited

U.S. PATENT DOCUMENTS

| | | | |
|---|---|---|---|
| 796,223 | 8/1905 | Kaub | 72/267 |
| 2,057,669 | 10/1936 | Brauchler | 72/354 |
| 3,399,560 | 9/1968 | Connolly et al. | 72/334 |
| 3,531,970 | 10/1970 | Pethick | 29/148.4 R |
| 3,566,513 | 3/1971 | Fuller | 29/557 |

*Primary Examiner*—Milton S. Mehr
*Attorney, Agent, or Firm*—R. L. Phillips

[57] ABSTRACT

A dieless method of hot forming a hole through a metal part comprising locally heating the part followed by indenting opposite sides of the part and extruding the displaced metal centrally of the indentations to form a thin annular wall section between the indentations and then punching out the thin wall section to complete formation of the hole.

5 Claims, 4 Drawing Figures

METHOD OF HOLE FORMING

This invention relates to a method of hole forming and more particularly to a dieless method of hot forming a hole through a thick metal part.

In the formation of a hole with a punch and die, there occurs cold work hardening of the surface of the hole which decreases tool life and may make the hole unsuitable for example in a press fit application without annealing. In addition, the conventional punch and die forming of holes produces a taper and the punch is typically marred further resulting in shortening of the tool life as well as producing a hole which then must be further worked such as by machining, grinding and/or burnishing to remove the taper and obtain a fine surface finish.

The present invention significantly reduces cold working to a negligible level in the hole while reducing the working load on the punch and produces a true cylindrical hole with a burnished finish. This is accomplished with a method which does not employ a die and instead comprises locally heating the metal part prior to any punching to substantially reduce the hardness thereof throughout a limited zone corresponding to the hole to be formed. Then the heated zone on opposite sides of the part are indented while extruding the displaced metal centrally of the indentations to form a pair of cavities having hole defining perimeters separated by a wall having a central extruded section of large thickness connected to the part by an annular wall section of small thickness compared to that of the part. As the final step, the thin annular wall section is then sheared from the part by punching to complete the formation of the hole which may be circular or of some other shape. It has been found that the heating eliminates or significantly reduces a cold worked condition in the hole with the resulting hardness levels similar to warm forming. In addition, this dieless forming of the hole with heating, indenting extrusion and punching produces a true cylindrical hole, i.e. one without taper, and in addition, the indentations act to trap the metal working lubricant to thereby form the hole with a burnished surface finish superior to conventional punch and die hole forming. The indentations also reduce the thickness to be punched or sheared and thus reduce both the tool load and tool wear thereby extending the tool life while aiding in producing a burnished hole. On the other hand, the present method enables the forming of a hole in a part that is substantially thicker than what can be punched with a conventional punch and die set.

An object of the present invention is to provide a new and improved method of hole forming.

Another object is to provide a dieless method of hot forming a hole through a metal part.

Another object is to provide a dieless method of hot forming a hole through a thick metal part by locally heating the part, indenting the heated zones on opposite sides of the part while extruding the displaced metal centrally of the indentations thereby producing a thin annular wall section separating the indentations and thereafter punching the thin wall from the part to complete the formation of the hole.

These and other objects and advantages of the present invention will be more apparent from the following description and drawing in which.

Figure 1:
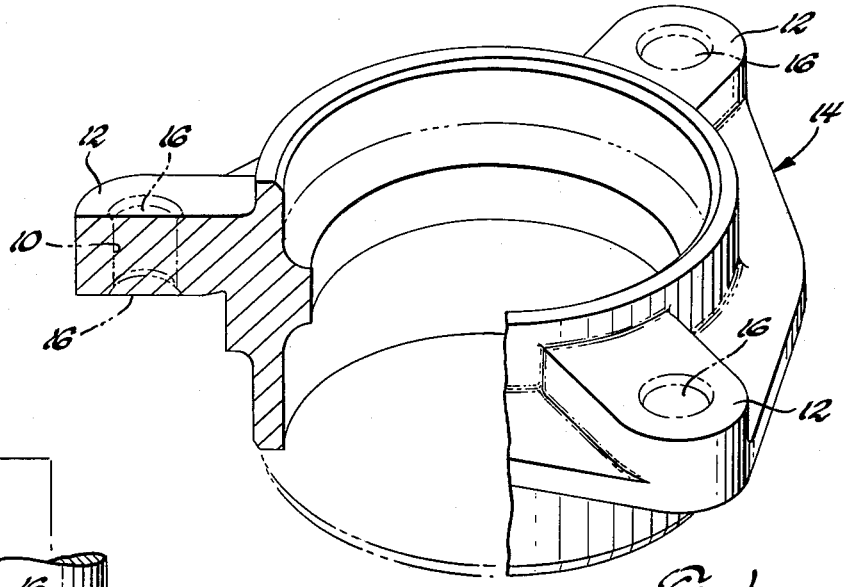
FIG. 1 is a three-dimensional view of a vehicle wheel spindle component with a section thereof removed and prior to the formation of holes therein by the dieless method of the present invention.

The method of the present invention is disclosed in use in forming a hole 10 in the thick flange portions 12 of a vehicle wheel spindle 14 which is a forged steel part and has been normalized or process annealed. In the as-forged condition, prior to the formation of the holes, the hole locations are spotted on the opposite sides of the part with a shallow indentation 16 whose diameter at the flat bottom thereof is equal to or slightly less than that of the desired hole. In the particular wheel spindle, the hole depth or thickness of the flange at the hole location is $16.00 \pm 1.00$ millimeters and the desired hole diameter is $12.37 \pm 0.25$ millimeters with roughness not to exceed 0.50 micromillimeters. The material type if AISI 1070 with over 0.4% C and the spindle has a core hardness of $R_c$ 18–30 and a surface hardness of $R_c$ 60–64.

Figure 2:
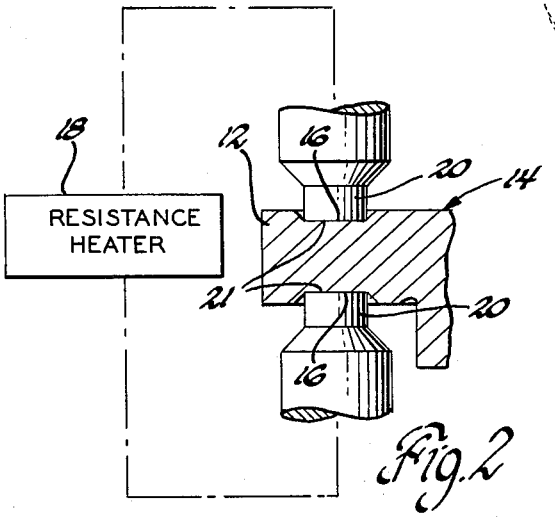
FIG. 2 is a diagrammatic view of resistance heating apparatus applying local heat to the wheel spindle component in FIG. 1 in a zone corresponding to the hole to be formed.

According to the present invention, the holes in the wheel spindle are formed without a die and to the prescribed dimension and surface finish and with a hardness approaching that of warm forming and without finishing and annealing by first locally heating the part to substantially reduce the hardness thereof throughout the zone corresponding to the hole to be formed. This may be accomplished as shown in FIG. 2 by a resistance heater apparatus 18 having opposed cylindrical electrodes 20 which receive the wheel spindle flange therebetween and have a radial flat circular end surface 21 which contacts the flat bottom of the shallow indentation 16 on the respective part side. The hole zone is heated to a temperature substantially less than the normal hot forging temperature of about 2,000° and preferably in the warm forming range of 1,200°–1,600° F.

Figure 3:
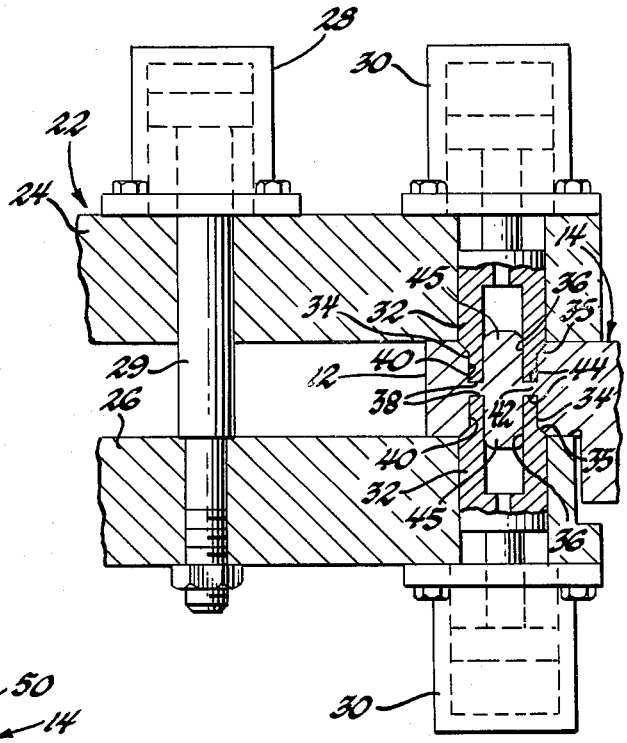
FIG. 3 is a diagrammatic view of indenting and extruding apparatus for indenting and extruding the previously heated zone on the wheel spindle.

After such local heating which may take approximately less than a second, the wheel spindle is then placed in the indenting and extruding apparatus 22 shown in FIG. 3 which has clamp members 24 and 26 that are operated by a cylinder 28 and piston 29 to clamp the wheel spindle flange in proper location therebetween. Thereafter, a pair of opposed cylinders 30 are operated simultaneously to force cylindrical indenting-extruding tools 32 against the opposite sides of the flange in the heated zone. The tools 32 are slidably mounted in the clamp members and have a reduced outer diameter 34 at their end and a tapered shoulder 35 which conform exactly in size and shape to the desired hole except as to hole depth. In addition, the tools 32 have a axially extending openings or central hole 36 in the end thereof leaving a radial flat annular end surface 38. The clamp members 24 and 26 thus serve only as support for the part and not as a die and as the tools are simultaneously forced toward each other they indent axially aligned cylindrical grooves or cavities 40 in the heated zone on opposite sides of the part while also extruding the displaced metal centrally of the annular grooves or indentations into the hollow center 36 of the tools. The depth of the indentations is slightly less than half the thickness of the part and there if thus formed an annular web or wall section 42 in the part separating the bottoms 44 of the grooves 40 which is substantially less than the thickness of the part while the central extrusions 45 project outward past the opposite sides or surfaces of the part and thus form a wall thickness central of the reduced wall section 42 that is greater than the thickness of the part. In the case of forming a round hole as shown, excellent results can be expected where the web 42 is formed with a thickness about one-fourth the hole diameter. And because cavities rather than a hole is thus formed during this step, the working lubricant on the part and/or the tools 32 is thus trapped during such metal working for most efficient use thereof.

Figure 4:
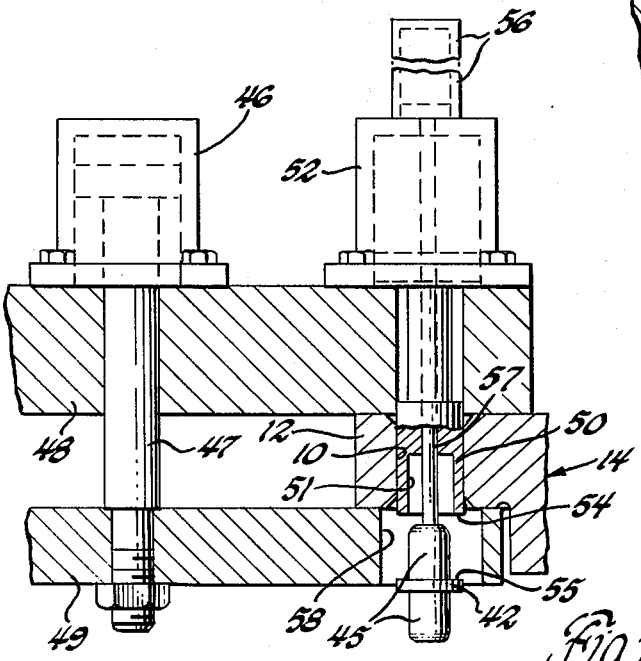
FIG. 4 is a diagrammatic view of punch apparatus for punching out the previously indented and extruded portion of the wheel spindle.

After formation of the annular indentations 40 and central extrusion 45, the part is then placed in the punch apparatus shown in FIG. 4 which comprises a cylinder 46 having a piston 47 that operates a pair of clamp members 48 and 49 to clamp the part therebetween. The indented and extruded portion of the part is aligned with a cylindrical punch 50 which has a central hole 51 in the end thereof for accommodating the upper extrusion 45 on the part. The punch 50 is operated by a cylinder 52 to engage a radial flat annular end 54 of the punch with the bottom 55 of the top annular indentation 40 to thereby shear the thin annular wall section 42 at the hole perimeter and punch out the thin wall section with the central extrusions 45 from the part at the outer perimeters of the indentations 40 to complete the formation of the cylindrical hole. A second cylinder 56 which is mounted atop of the cylinder 52 operates an ejector pin 57 which is slidable through the center of the punch to eject the punched-out slug from the hollow end of the punch and through a hole 58 in the lower clamp member 49 immediately following the punching operation.

In summary then, the heating of the part prior to the indenting thus eliminates a cold worked condition in the hole and the hole is punched without the need for a die because of the intermediate step of indentation or metal displacement combined with central extrusion of the displaced material. As a result, there is formed a burnished hole without taper which need not be further worked after the punching operation to provide the required fine surface finish. And by indenting both sides, that portion of the par which is sheared during the punching operation has a substantially reduced thickness compared to the surrounding part and this reduces the tool load and the tool wear resulting in both extended tool life and the burnished hole. And it will also be appreciated that while the invention has been applied to form a circular cylindrical hole, holes other than circular can, of course, be likewise formed. Furthermore, such method enables the easy formation of a hole in parts made of material other than metal such as plastic and also in metal parts whose thickness is greater than that capable of being punched with a conventional punch and die set in the normal manner. And it will also be understood that only one of the cavities formed by indentation need be annular with all the displaced metal extruded to the center thereof while the other cavity could then be simply a blind hole to thus form the thin wall section for the final punching step.

The above described embodiment is illustrative of the invention which may be modified within the scope of the appended claims.

The embodiments of the invention in which an exclusive property or privilege is claimed are defined as follows:

1. A dieless method of hot forming a hole in a part of substantial thickness comprising:

heating the part to substantially reduce the hardness thereof throughout the zone in which the hole is to be formed, relatively moving a pair of tools to engage opposite sides of the part at the heated zone and to displace and extrude material from the heated zone from at least one side of the part into an axially extending opening in at least one of said tools to define an annular axially extending groove having a depth which leaves an integral annular wall section intermediate the sides thereof having a thickness substantially less than that of the part, and separating the annular wall section from the part to complete the formation of a hole through the part.

2. A dieless method of hot forming a cylindrical hole in a part of substantial thickness comprising:

heating the part to substantially reduce the hardness therof throughout the zone in which the hole is to be formed, relatively moving a pair of cylindrically shaped tools having axially extending openings therein toward each other to displace and extrude material from the heated zone from opposite sides of the part into the axially extending openings in said tools until the extruded material has a thickness greater than that of the part and terminating said relative movement of the tools at depths within the part which leaves an integral annular wall section intermediate of the sides of the part having a thickness substantially less than that of the part, and separating the annular wall section from the part to complete the formation of a cylindrical hole through the part.

3. A dieless method of hot forming a cylindrical hole through a metal part of substantial thickness comprising:

locally heating the part to substantially reduce the hardness thereof throughout a limited zone corresponding to the hole to be formed, relatively moving a pair of cylindrically shaped tools having axially extending openings therein to indent the heated zone from opposite sides of the part and extrude metal displaced by indenting the opposite sides of the part into the axially extending openings in the tools to form a pair of aligned cavities having a depth less than one half the original thickness of the part to define an annular wall section intermediate the sides of the part having a thickness substantially less than that of the part, and punching the annular wall section from the part to complete the formation of a cylindrical hole through the part.

4. A dieless method of hot forming a cylindrical hole through a metal part of substantial thickness comprising:

locally heating the part to substantially reduce the hardness thereof throughout a limited zone corresponding to the hole to be formed, relatively moving a pair of tools having central holes therein to indent the heated zone from opposite sides of the part and extrude metal displaced by indenting the opposite sides of the part into the central holes of the tools to form a pair of aligned cavities wherein at least one of the cavities is a cylindrical groove and both cavities have a depth less than one half the thickness of the part to define a wall section intermediate the sides of the part having a thickness substantially less than that of the part, and punching the annular wall section from the part to complete the formation of a cylindrical hole through the part.

5. A dieless method of hot forming a cylindrical hole in a metal part of substantial thickness comprising:

heating the part to substantially reduce the hardness thereof throughout the zone in which the hole is to be formed, relatively moving a pair of cylindrically shaped tools having axially extending openings therein toward each other to indent axially aligned cylindrical grooves having a depth less than one half the thickness of the part in the heated zone on opposite sides of the part and extrude metal displaced from the grooves into the axially extending openings of the tools to define between the grooves an integral annular wall section having a thickness substantially less than that of the part, and separating the annular wall section from the part to complete the formation of a cylindrical hole through the part.

* * * * *